United States Patent [19]

Tuson

[11] 4,226,204

[45] Oct. 7, 1980

[54] OFF-SHORE MOORING DEVICE FOR A LARGE-SIZED FLOATING BODY

[75] Inventor: Samuel Tuson, Mesnil-le-Roi, France

[73] Assignee: Entreprise d'Equipements Mecaniques et Hydrauliques E.M.H., France

[21] Appl. No.: 863,325

[22] Filed: Dec. 22, 1977

[30] Foreign Application Priority Data

Dec. 24, 1976 [FR] France ..... 76 39081
Dec. 14, 1977 [FR] France ..... 77 37690

[51] Int. Cl.[2] ..... B63B 21/00
[52] U.S. Cl. ..... 114/230; 9/8 P
[58] Field of Search ..... 9/8 P; 114/230, 293, 114/264; 141/387, 388

[56] References Cited

U.S. PATENT DOCUMENTS

| | | | |
|---|---|---|---|
| 3,605,415 | 9/1971 | Mohlman | 114/264 X |
| 3,677,302 | 7/1972 | Morgan | 9/8 P X |
| 3,919,958 | 11/1975 | Graham et al. | 114/264 |
| 4,088,089 | 5/1978 | Flory | 9/8 P X |
| 4,090,538 | 5/1978 | Kotcharian | 9/8 P |

*Primary Examiner*—Sherman D. Basinger
*Attorney, Agent, or Firm*—Steinberg and Blake

[57] ABSTRACT

An off-shore device for mooring a large-sized floating body to an anchoring system anchored to the sea bed, comprising a mooring head located above water level and connected to said anchoring system by a connecting arrangement capable of withstanding tractive force and tiltable in any direction as well as a possibly adjustable tractive force generator providing a vertically upwardly directed force component and adapted to act upon said mooring head while bearing upon said floating body.

5 Claims, 8 Drawing Figures

OFF-SHORE MOORING DEVICE FOR A LARGE-SIZED FLOATING BODY

BACKGROUND OF THE INVENTION

The present invention relates essentially to a mooring device for a large-sized floating body for use in particular at an off-shore location and of the type comprising an anchoring system anchored to the sea bed or bottom. By "large-sized floating bodies" is generally hereinafter meant, without being limited to the following listing, big floating units such as barges, ships such as oil tankers, floating plants or like water-borne factories; semi-submersible platforms or rigs; and/or floating storage tanks etc., used for instance for storing and/or treating mineral products such as petroleum, natural gases (methane) etc. extracted from the sea bed.

Mooring devices of the kind referred to hereinabove are already known in the prior art, wherein for instance the mooring is provided by a more or less large float or buoy tied or fastened to the anchoring system through a possibly rigid connection pivotally connected in such a case to the float.

Such known arrangements exhibit the inconvenience of having large floats or buoys subjected through the swell of the sea or through movement of the ship itself to very large forces so that the pivotal connections are heavily stressed or strained. Moreover, the use of chain systems would result in or give rise to complicated designs since they require several (usually from 6 to 8) points of connection with the sea bottom.

SUMMARY OF THE INVENTION

One main object of the present invention is to remove or alleviate such inconveniences and to provide a mooring device which is convenient in use and which would only require one single point of connection with the sea bed as well as being relatively insensitive to the effects of the swell.

For this purpose, a mooring device of the kind mentioned hereinabove is, according to the invention, characterized in that it comprises a mooring head located at or above the water surface or sea level and which is connected to said anchoring system through a connection adapted to withstand pulling or tractive force and which is tiltable to various inclinations in various vertical planes or directions, and, preferably, an adjustable tractive or pulling force generating system providing an upward directed vertical force component adapted to act upon said mooring head while bearing upon the floating body.

It will be appreciated that the upward directed pulling force component to which the mooring head is subjected when the floating body is relatively spaced or remote from the vertical of the anchoring system and when therefore the pull-resistant connection is inclined with respect to the vertical direction, is one of the two components of a pulling force necessarily exerted along the center line axis of said connection whereas the other or horizontal force component is directed towards the floating body because the force produced by said force generator would originate from said floating body.

Therefore, the floating body would itself undergo a biassing, drawback or restoring force with a downwardly directed vertical component, whereby the floating body would slightly sink or subside, i.e. be moved downwards (with an attendant slight increase in its draught), and with a horizontal force component directed towards the mooring head, whereby the floating body will be caused to be moved back towards the vertical of its anchoring system while overcoming the effects of the wind, or sea currents, flows or streams and of the swell as well as any drift generating effects until the aforesaid horizontal force components vanish or become zero and a state of equilibrium or condition of balance is achieved. The upwardly directed pulling force exerted upon the mooring head will then be directed substantially vertically.

It is thus apparent that a significant advantage of the invention derives from the possibility of obtaining a nearly permanent and rather firm and narrow or tight mooring of the floating body which will thereby always be caused to be driven back towards the vertical of its anchoring system without the need of using large-sized floats or buoys and which advantageously requires only a single anchoring point.

Preferably, a mooring device according to the invention is further characterized in that said pull-resisting connection consists of a preferably tubular and possibly elongated structure such as an emerging column connected to the anchoring system (such as a gravity base anchored or resting onto the sea bed) by means of an articulated or pivotal connection consisting for instance of a so-called universal joint or Hooke's or Cardan coupling.

A significant advantage of such an arrangement resides in the fact that said pull-withstanding connection may then further be used as a protective sheath or casing serving as a passage-way for various pipe-lines or like ducts connecting the sea bottom (for instance an oil or gas storage) to the floating body. The universal joint, Hooke's or Cardan coupling, forming said pivotal connection, would enable the pull-resisting connection to assume various tilted or inclined position in various vertical planes in a known manner.

Likewise, as known per se, said structure may consist of several rigid elements or sections pivotally connected to each other through universal joints or like Cardan couplings. Such structure is particularly useful at very great depths.

According to the invention, the mooring head is rotatably mounted at the upper or emerging end of said structure so that it may revolve on the latter about its substantial longitudinal centre line axis and said pulling force generating system is adapted to act upon said mooring head through the agency of a pivotal connection such as a universal joint or Cardan coupling.

The floating body may thus freely swing around the mooring head and its pitching and rolling motions are thus unlikely to damage the latter.

The pulling force generator advantageously comprises at least one pressure fluid or hydraulically operated power ram or similar jack-like actuator the feed fluid pressure of which is preferably adjustable and preferably supplied by a bank or battery of oleopneumatic accumulators.

Any other kind of force generator suited to meet the operating requirements or working conditions set could however be contemplated. Likewise, a system could for instance be used wherein the required force would be exerted upon the mooring head by means of strong springs or by resilient rubber pads or through the agency of a hawser made from nylon or like synthetic material or also by a system of counterweights with linkages or levers and/or cables and pulleys or sheaves.

According to an advantageous embodiment of the invention, the pull force generating system is carried by the floating body through the agency of a rigid arm or lever mounted thereon. This rigid arm or lever may prevent the floating body from running against, hitting or striking the mooring head and in addition, it may facilitate leading the various pipe-lines extending or originating from the sea bottom to the storage tanks and other planes provided on the floating body.

Preferably, the pull force generator system would act upon the mooring head through the medium of a rigid arm or lever pivotally connected to the floating body for rotary movement about a substantially horizontal pivot axis.

The pivot axis of the rigid arm may be located between its two opposite ends which are connected to the force generator and to the mooring head, respectively, and the pivot axis may be aligned in substantially registering relationship with said both ends or alternatively it may be positioned outside of the line joining both arm ends.

In the case where the force generating system consists of a counterweight substituted for the hydraulically operated powder ram or like linear actuator, this would result in tha advantage of dispensing with any pressure fluid supply source required when using hydraulically operated actuators.

For this purpose and according to still another characterizing feature of the invention, in the case of a mooring device comprising on the one hand an anchoring system preferably of the type having a gravity base secured or resting onto the sea bed and to which is articulated an emerging column with a revolving or swivel mooring head rotatably mounted at the emerged top head of said column, and, on the other hand, a force generator system acting upon said mooring head by means of a lever pivotally mounted or swingable about a substantially horizontal axis supported by said floating body, said lever being pivotally connected with one end thereof in a removable manner to said mooring head, said force generating system is a counterweight directly mounted at the other or opposite end of said lever.

According to a further characterizing feature of the invention, the mooring device includes an appliance for damping the movements of the floating body with respect to the mooring device, consisting of a movable member such as a plunger piston movable within a liquid medium contained within an enclosed space having preferably substantially vertical walls with respect to the floating body, said piston being connected to said force generator or counterweight whereas said enclosed space consists of a pit or well directly provided within for example the hull structure of said floating body and fully extending therethrough to open directly through its bottom underneath said floating body into the liquid or sea water surrounding same.

DESCRIPTION OF THE DRAWINGS

The invention will be better understood and further objects, characterizing features, details and advantages thereof will appear more clearly as the following explanatory description proceeds with reference to the accompanying diagrammatic drawings given by way of non-limiting examples only illustrating several presently preferred specific embodiments of the invention and wherein.

DESCRIPTION OF THE PREFERRED EMBODIMENTS

Figure 1:
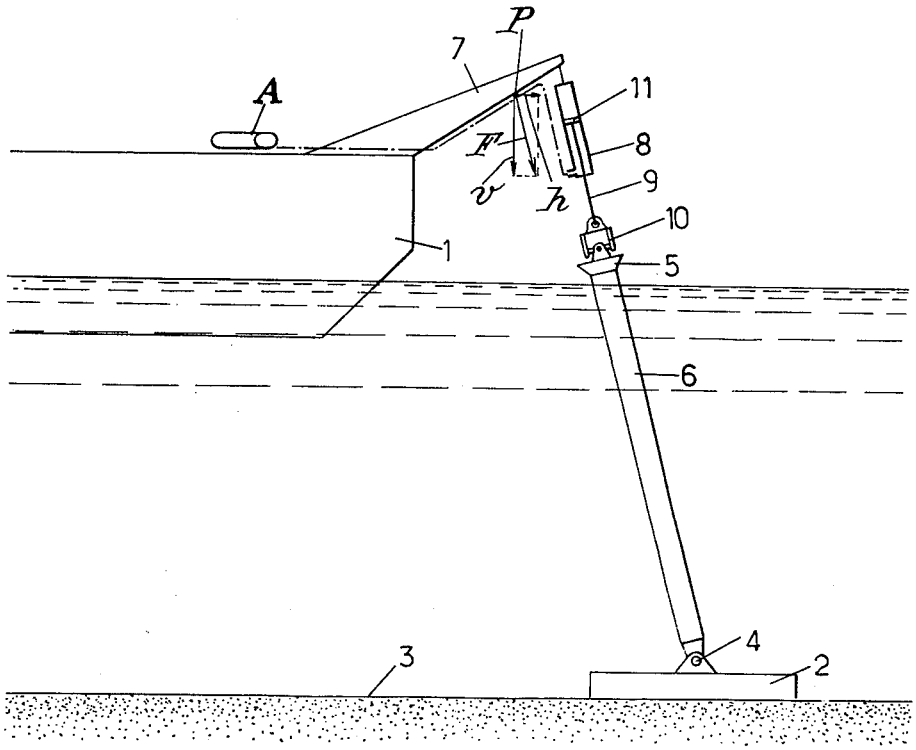
FIGS. 1 and 2 show two possible embodiments, respectively, of the mooring device, the first embodiment utilizing a rigid arm secured onto a floating body, such, for example, as to an oil tanker while the second embodiment utilizes a rigid lever pivotally connected to the ship.

Referring to FIG. 1, there has been shown as designated by the reference numeral 1, a large-sized floating body such as for instance an oil tanker to be moored at a given anchorage or mooring place permanently or nearly permanently.

The mooring device comprises for this purpose a conventional anchoring system 2 diagrammatically shown which may be a gravity base simply resting on the sea bottom 3 or a base construction secured or fastened into the marine bed or ground by means of pins or piles rammed or driven or bored into the marine floor. A rigid, pull-resistant connecting structure for instance of tubular construction such as an emerging articulated column 6 is connected with its lower end to the base 2 by means of a pivotal connection preferably a universal joint or Cardan coupling 4 also diagrammatically shown in the drawing.

The device further comprises a mooring head 5 located at or above the water surface or sea level and rotatably mounted at the upper end portion of the connecting structure or column 6 which thus connects the anchoring system 2 to the mooring head 5 which may freely revolve or swivel about the longitudinal centre line axis of the column 6.

On the deck of the ship 1 is secured an outwardly projecting or outboard overhanging rigid arm 7 to the free end of which is pivotally connected the end of a force generator adapted to exert a pull upon the mooring head 5. In the embodiment shown as well as in the embodiment illustrated in the other figures and although as mentioned hereinabove many other systems could be contemplated, this force generator consists of a hydraulically operated power ram or like linear piston-and-cylinder actuator the cylinder 8 of which is pivotally connected to the free end of the rigid arm or boom 7 whereas its piston rod 9 is removably connected to the mooring head 5 through the agency of another universal joint or Cardan coupling 10.

A fluid for instance such as oil under constant or controlled pressure is fed into the cylinder 8 below the piston 11 thereof by being supplied thereto through a piping shown in chain dotted lines and connected to a supply source A mounted aboard the ship, such as for instance a set or bank of oleopneumatic accumulators of known type.

Thus, an upwards directed pulling force is permanently exerted upon the actuator piston hence upon the mooring head 5. This force is of course directed along the axis of the pull-resistant connecting structure 6 and may be resolved into an upwardly directed vertical component and into a horizontal component directed towards the ship.

It results therefrom that the power cylinder 8, the arm or boom 7 and accordingly the ship 1 are subjected to an opposing downwardly directed draw-back, restoring or biassing force F acting along the longitudinal axis of the connecting structure 6; this force may be resolved into one downwards directed vertical component v and into a horizontal component h directed towards the mooring head 5. For the sake of convenience the point P of application of that force to the arm 7 has been shown in a somewhat offset or shifted position.

The ship 1 is therefore subjected to a downwards pointing vertical force v which causes its draught to increase slightly and to a horizontal force h which constantly urges the ship back towards the vertical of its anchoring system 2 until reaching the position of equilibrium in which the connecting structure 6 has been brought back to the vertical position.

Figure 2:
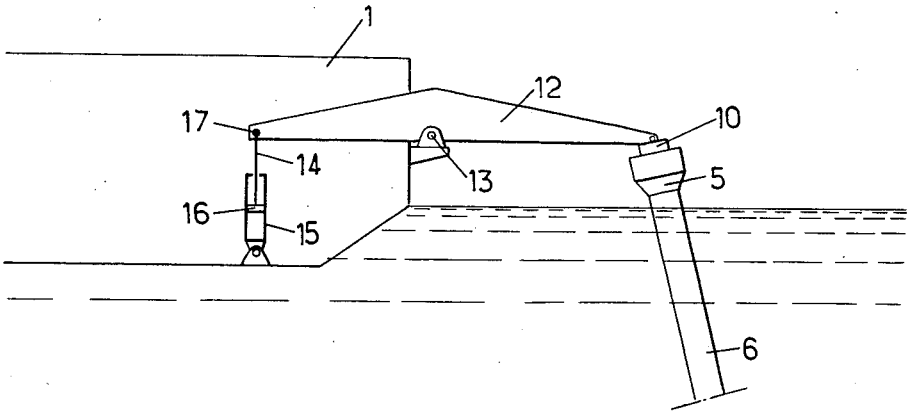

In the embodiment shown in FIG. 2, the principles used are just the same as herein before but there is provided a rigid, substantially rectilinear arm or lever 12 pivotally mounted for swinging motion on a horizontal axis 13 located, for instance, adjacent to the bow of the ship. The end of this lever which is projecting outboard from the ship is removably connected like the arm or boom 7 to the universal joint or Cardan coupling 10 carried by the mooring head 5. The other or opposite end of the lever is pivotally connected to the piston rod 14 of a hydraulically operated piston-and-cylinder linear actuator the cylinder 15 of which is pivotally connected to the ship's structure. The hydraulic fluid is fed into that cylinder above the actuator piston 16 slidebly mounted therein so that a downward pull is exerted upon the end 17 of the lever 12 thereby resulting in an upward pull exerted by the other or opposite end of the lever 12 upon the head 5 with the same consequential effects as in the previous embodiment.

With the embodiment of FIG. 2 is however obtained the additional advantage that the relative motions between the ship and the point to which the force is applied are of reduced magnitude; moreover, the forward portion or bow of the ship will never hit or strike the mooring head 5, which is not the case with the embodiment shown in FIG. 1. Furthermore, by suitably selecting the position at which the rigid swinging lever 12 is pivotally mounted onto the fulcrum axis 13, it is possible to use the lever arm effect and, for instance, to use a more powerful actuator but having a smaller stroke than in the case of FIG. 1 by offsetting or shifting the bearings holding the pivot axis or fulcrum 13 of the lever 12 towards the end 17.

Finally, with such an embodiment, the fluid conveying and electrical power line connections with the ship may be installed or provided more easily than in the case of FIG. 1 because the mechanical connections from the universal joint or Cardan coupling 10 with the ship only involve rotations about horizontal axes. The installation of the actuator is also simplified since the piston rod 14 of the actuator only moves in a single vertical plane of the ship.

Figure 3:
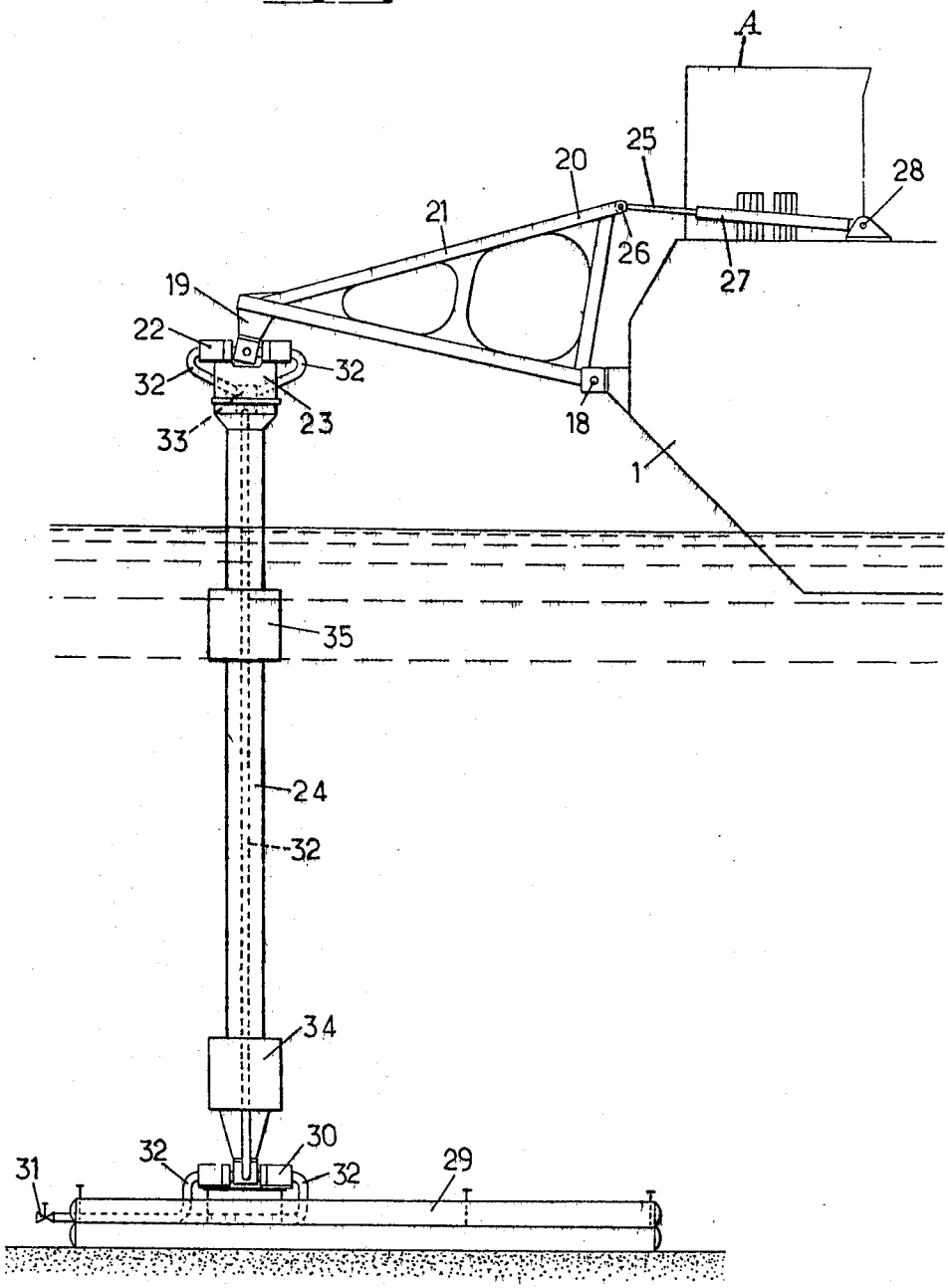
FIGS. 3 to 5 show a third embodiment using a rigid arm or lever of another kind also pivotally connected to the ship and illustrating in three possible positions, respectively, namely: a current balance position, a first and a second end positions.
Figure 4:
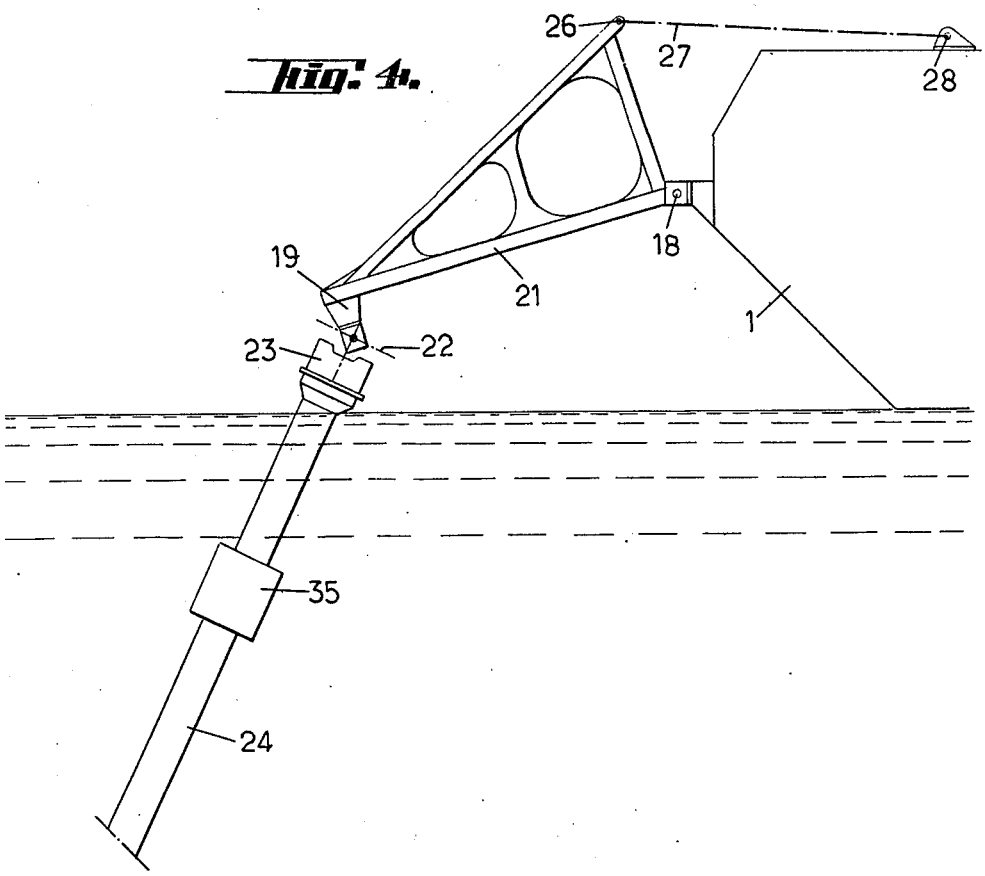
Figure 5:
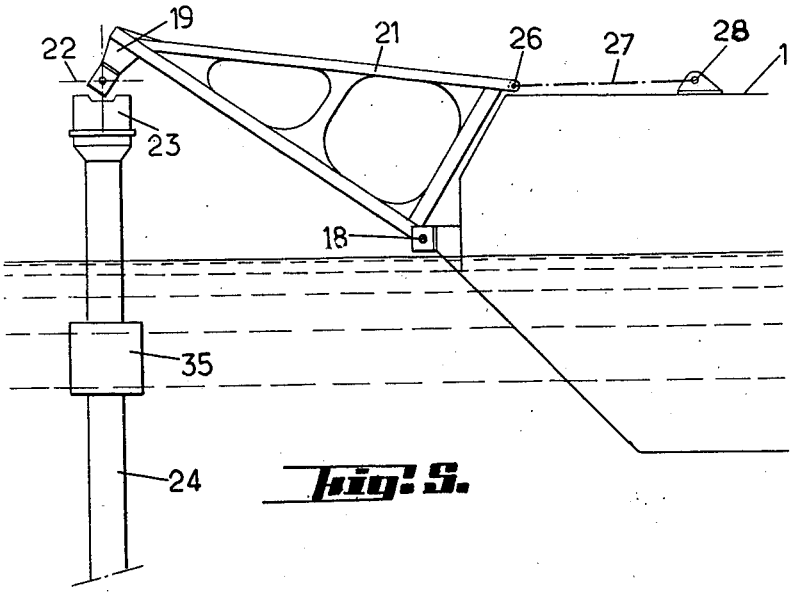

In FIGS. 3 to 5, another embodiment of a mooring device according to the invention is shown which is illustrated in greater detail in order to better disclose further interesting aspects of the invention.

In the embodiment of FIG. 2, the fulcrum or pivot axis 13 of the lever 12 was substantially aligned with both opposite ends of the latter. In the embodiment of FIGS. 3 to 5, this fulcrum axis shown at 18 is located outside of the straight line which joins the ends 19 and 20 of the rigid arm designated by the reference numeral 21, which ends are connected respectively as in the embodiment just described hereinbefore to a universal joint or Cardan coupling 22 carried by a revolving mooring head 23 mounted at the top end of a pull-resistant connecting structure or column 24 and to a piston rod 25 of a hydraulic actuator through the medium of a pivotal connection with a horizontal pivot axis 26; the cylinder casing 27 of that actuator which is only symbolically shown in chain dotted lines in FIGS. 4 and 5 is pivotally connected through a horizontal pivot axis or pin 28 to the ship 1. The bank of oleopneumatic accumulators feeding the actuator has also been shown at A in FIG. 3.

It is seen that all of these arrangements may be conveniently carried out by adopting a rigid arm 21 of generally triangular configuration.

In FIG. 3 have been shown greater detail the anchoring system 29, the universal joint or Cardan coupling 30 through which the bottom end of the structure or column 24 is connected to said system and a fluid supply valve 31 communicating with storage tanks or other plants aboard the ship through pipe-lines generally designated by the reference numeral 32.

In a known manner these pipe-lines extend through the universal joints or Cardan couplings 30 and 22 along the respective orthogonal pivot axis thereof as well as through the rotary head 23 through the medium of a preferably rotary axial sealing joint 33. (These latter parts of the device have not been shown in FIGS. 4 and 5 for the sake of simplifying the latter). The ducts or pipe-lines are then carried by the arm 21 to extend to the ship.

It is seen that that portion of the ducts 32 which extends between both Cardan couplings 30 and 22 is advantageously provided inside of the rigid connecting structure or column 24 which is of tubular construction and also serves as a protecting casing or sheath.

At 34 has been shown a weight or body made for instance from concrete and mounted on the connecting structure or column 24 near the lower end thereof and adapted to relieve the bearings of the universal joint or Cardan coupling 30 of at least one part of the upward directed pulling forces which are exerted thereon on account of the action of the arm 21 and at 35 has been shown a buoyant member or float means of relatively small size mounted onto the connecting structure or column 24 towards the upper end portion thereof and adjacent to but below the water surface or sea level and which is adapted to increase the hydrostatic stability of the whole assembly.

The mooring device which has just been described will of course operate according to same principles as the one set forth in the first place, the pulling force exerted by the actuator 27 upon the end 20 of the arm 21 resulting, owing to the stationary bearing or fulcrum provided at 18, in a upward directed pulling force exerted by the other end 19 upon the mooring head 23.

In FIG. 3, the positions of the arm 21 and of the connecting structure or column 24 would correspond to an average state of equilibrium i.e. a mean condition of balance the ship having for instance a draught of 5 m and the tide being at low water. The piston of the actuator 27 is then positioned about half-way of its stroke.

In FIG. 4, the connecting structure 24 is tilted to an extreme inclined position and the actuator piston rod is extended outwards to its utmost extent; the ship has for instance again a draught of 5 m and the tide is assumed to be at high water with a pounding effect of about 5 m. (The ship is shown in its uppermost position).

In FIG. 5, on the contrary, has been shown the reverse extreme position in which the connecting structure 24 is vertical and the actuator 27 has its piston rod in its fully retracted position. Such a situation may occur for instance when the ship is loaded and the tide is at high water, with, for instance, a ship's draught of 11 m and a pounding of about 5 m. (The ship is shown in its lowermost position.)

The embodiment described with reference to FIGS. 3 to 5 of course exhibits the same advantages as the embodiment shown in FIG. 2 with, however, the additional advantage of avoiding any interference between the arm and the ship's superstructure, due to the fact that the arm is located fully outboard. Moreover, the installation of the actuator is more easily carried out because it may practically be laid flat onto the deck and it is then easier to use a power ram or actuator with a very long stroke which could be 10 m to 12 m long.

It should be pointed out that the sets of oleopneumatic accumulators may be fitted with an oil pressure control or monitoring system but as a general rule, such a system should not be necessary. In any case, in view of the provision of such banks or batteries, the use of any interlock control, monitoring, feedback or follow-up system may be avoided because the actuator piston may always move freely within the actuator cylinder in accordance with the height of the tide and the swell while maintaining the pulling force upon the arm or lever.

Figure 6:
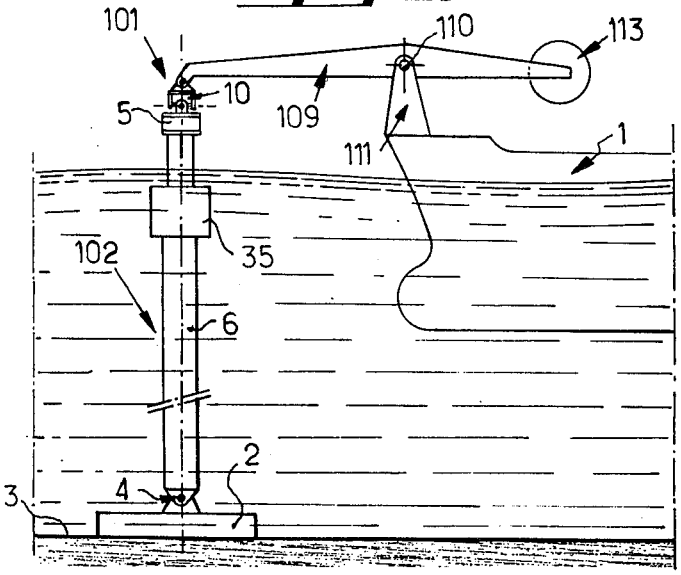
FIG. 6 is a view in partial longitudinal section of an alternative embodiment of the mooring device which is a modification of the one illustrated in FIG. 2.
Figure 7:
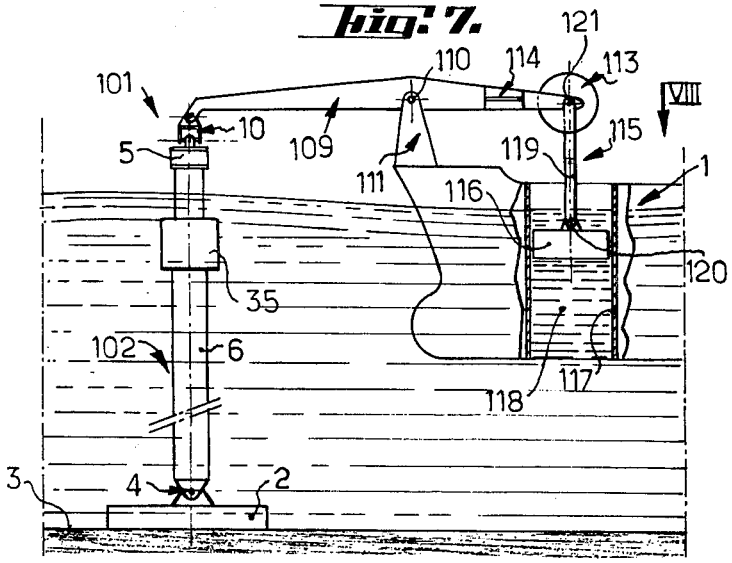
FIG. 7 is a view in partial longitudinal section of an improvement to the mooring device shown in FIG. 6 and incorporating a damping arrangement.
Figure 8:
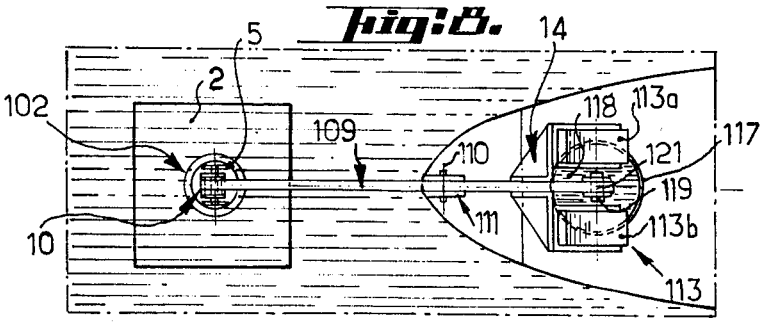
FIG. 8 is a top view seen in the direction of the arrow VIII of FIG. 7.

Referring now to FIGS. 6 to 8, the mooring device 101 according to still another embodiment of the invention comprises as in the embodiment of FIG. 2 an anchoring system 102 with an articulated column having a mooring head 5 adapted to be connected to the floating body such as a ship 1 by means of a swinging lever 109 having a substantially rectilinear configuration.

This swinging lever 109 is pivotally removably mounted intermediate of its two opposite ends about a bearing fulcrum axis 110 extending substantially horizontally with respect to the ship and carried by a yoke-shaped holder bracket or like supporting clevis 111 rigidly secured to the structure or hull of the ship 1 towards one end such as the fore end or bow of the latter. The outboard projecting end of the lever 109 which is adjacent to the mooring head 5 is adapted to be pivotally connected thereto by means of a universal joint or like Cardan coupling 10. For this purpose, one of the pivot axes or pins of the Cardan coupling 10 is supported by the mooring head 5 whereas the other pivot axis or pin of the Cardan coupling is held by said outboard end of the lever 109.

A preferably adjustable counterweight 113 is directly mounted on the free inboard end of the swinging lever 109. This counterweight 113 is accordingly overhanging the deck of the ship 1. Referring now to FIG. 8, the couterweight 113 may, for instance, consist of two counterweight portions 113*a*, 113*b* mounted on either side of the adjacent inboard end of the lever 109 while being supported by a rigid structure 114 thereof also extending on either side of that end of the lever 109. The counterweight 113 may of course have any other shape and/or adjustable weight and be mounted in various manners on the corresponding end of the lever 109.

The embodiment shown in FIGS. 7 and 8 differs from the previous embodiment according to FIG. 6 only by the fact that it additionally comprises a damping appliance 115 for damping the motions of the ship with respect to the mooring device. This damping appliance 115 consists for instance of an element 116 such as a piston movable or slidable within an enclosed space 117 with substantially vertical walls in relation to the ship and in which is entrapped or contained a liquid. This enclosed space 117 consists desirably of a pit or well directly provided in the structure of the floating body or the hull of the ship 1 and fully extending therethrough to open underneath the ship or floating body 1 into the surrounding liquid medium such as the sea water through a calibrated bottom hole for instance. In this manner, a liquid column 118 is automatically provided within enclosed space or pit 117 which will serve the purpose of damping the motions of the piston 116. This piston 116 is connected to the mooring device by means of a rod 119 both opposite ends of which are respectively connected to the piston 116 by means of a pivotal connection 120 and to the inboard (or counterweight carrying) end of the lever 109 through a pivotal connection 121. This piston rod 119 instead of being pivotally connected to the lever 109 could, of course, be pivotally connected directly for instance to the counterweight 113.

In operation, such a mooring device owing to the provision of the counterweight 113 which permanently exerts an upward directed vertical force upon the mooring head 5 thereby has constantly the tendency to bring the ship 1 back towards the anchoring system 102 as soon as the ship tends to move away therefrom as already described hereinabove.

It is to be understood that the invention should not be construed as being limited to the embodiments described herein and shown in the drawings but additionally comprises the technical equivalents of the means described as well as their combinations if same are carried out and used within the scope of the appended claims.

What is claimed is:

1. An off-shore mooring device for a large-size floating body with an anchoring system for anchoring the floating body to the sea bed, comprising: a mooring head located above sea level and rotatably mounted at the upper end of a column-like structure, the latter being connected at its other end to said anchoring system by means of a universal joint; a rigid arm fixedly secured to said floating body to overhang in an outboard fashion therefrom; and a pulling force generator providing a vertical force component adapted to act substantially upwardly upon said mooring head and which is impressed on said floating body, said force generator comprising at least one hydraulically operated piston-and-cylinder linear actuator with a selectively adjustable fluid feed pressure, wherein said actuator is pivotally coupled to the free end of said rigid arm and adapted to be removably connected to said mooring head so as to draw said free end towards said head or withdraw it therefrom.

2. A mooring device according to claim 1, including a set of oleopneumatic accumulators for supplying said fluid feed pressure.

3. A mooring device according to claim 1, wherein said column-like structure is of substantially tubular or hollow construction.

4. An off-shore mooring device for a large-size floating body with an anchoring system for anchoring the floating body to the sea bed, comprising: a mooring head located above sea level and rotatably mounted on the upper end of pull-withstanding substantially column-like structure, the latter being connected at its other end to said anchoring system by means of a universal joint; a rigid lever pivotally connected to said floating body about a substantially horizontal pivot axis; and a pulling force generator providing a vertical force component adapted to act substantially upwardly upon said mooring head and which is impressed upon said floating body, said force generator comprising at least one hydraulically operated piston-and-cylinder linear actuator with a selectively adjustable fluid feed pressure, said pivot axis being positioned at a point intermediate the ends of said lever and one end of said lever being removably connectable to said mooring head, wherein said lever has a substantially rectilinear configuration and extends substantially horizontally or under a relatively small angle with respect to the horizontal direction when said column-like structure is in its vertical position, and wherein said actuator is interposed between the free end of said lever and the floating body and is substantially vertically disposed.

5. An off-shore mooring device for a large-size floating body with an anchoring system for anchoring the floating body to the sea bed, comprising: a column pivotally connected to said sea bed and carrying rotatably at its top end, which extends above the surface of the sea, a revolving mooring head; a lever structure having two ends pivotally mounted about a substantially horizontal pivot axis carried by said floating body, the pivot axis being located between said ends of the lever structure, the lever structure being connectable at one of said ends to said mooring head, and a counterweight mounted on the other of said ends of said lever structure, wherein said lever structure is constituted by a substantially rectilinear lever which extends substantially horizontally when said column extends substantially vertically, and further including a piston movable within a liquid medium entrapped within an enclosed space having substantially vertical walls with respect to said floating body, said piston being connected to said counterweight through connecting rod means extending in the direction of the movement of said piston, said enclosed space being defined by a pit extending substantially vertically and fully through said floating body to open directly underneath said floating body into the surrounding liquid through a calibrated bottom hole so as to provide a damping liquid column within said pit.

* * * * *